US009317052B1

(12) United States Patent
Hwang

(10) Patent No.: US 9,317,052 B1
(45) Date of Patent: Apr. 19, 2016

(54) SEMICONDUCTOR APPARATUS WITH CALIBRATION CIRCUIT AND SYSTEM INCLUDING THE SAME

(71) Applicant: SK hynix Inc., Gyeonggi-do (KR)

(72) Inventor: Tae Jin Hwang, Gyeonggi-do (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 14/552,141

(22) Filed: Nov. 24, 2014

(51) Int. Cl.
*G05F 1/10* (2006.01)
*G05F 1/46* (2006.01)

(52) U.S. Cl.
CPC ..... *G05F 1/468* (2013.01)

(58) Field of Classification Search
CPC ..... G05F 1/468; H03K 19/0005
See application file for complete search history.

(56) References Cited

U.S. PATENT DOCUMENTS 8,760,188 B2 * 6/2014 Gondi ..... H04L 25/028 326/30
2008/0001623 A1 * 1/2008 Kim ..... H03K 19/0005 326/30
2012/0062275 A1 * 3/2012 Hiraki ..... H03K 19/017545 326/30
2015/0155867 A1 * 6/2015 Dietl ..... H03K 19/017545 326/30

FOREIGN PATENT DOCUMENTS

KR 100532426 11/2005
KR 1020120087572 8/2012

* cited by examiner

*Primary Examiner* — Jeffrey Zweizig
(74) *Attorney, Agent, or Firm* — IP & T Group LLP

(57) ABSTRACT

A calibration circuit of a semiconductor apparatus may include: a reference voltage generator suitable for generating first and second pull-up reference voltages based on a pull-up control signal, and generating first and second pull-down reference voltages based on a pull-down control signal; and a calibrator suitable for generating a pull-up resistor code corresponding to an external reference resistor based on the first and second pull-up reference voltages, and generating a pull-down resistor code corresponding to the external reference resistor based on the first and second pull-down reference voltages and the pull-up resistor code.

19 Claims, 5 Drawing Sheets

SEMICONDUCTOR APPARATUS WITH CALIBRATION CIRCUIT AND SYSTEM INCLUDING THE SAME

FIELD OF THE INVENTION

Various embodiments of the present invention relate to a semiconductor apparatus and, more particularly, to a semiconductor apparatus with a calibration circuit and a system including the same.

BACKGROUND

In general, semiconductor apparatuses, such as a processor and a memory device, are implemented with integrated circuits and used in various types of electronic devices such as a desktop computer, a laptop computer, a mobile phone, an electronic scheduler, a portable audio player, a camera, and a smart phone. Semiconductor apparatuses have gradually reduced in size, their operation speed has increased, and their power consumption has decreased.

A semiconductor apparatus may perform data communication while exchanging signals. Thus, the performance of the semiconductor apparatus may be determined by how precisely signals are transmitted and received. However, the miniaturization, the high-speed operation, and the low power consumption of semiconductor apparatuses may make it difficult for the them to precisely transmit and receive signals. Thus, various technologies for precisely transmitting and receiving signals under a severe operating environment have been developed and applied to semiconductor apparatuses.

SUMMARY

Various embodiments of the present invention are directed to a semiconductor apparatus, which is capable of separately controlling reference voltages for setting a pull-up resistor and a pull-down resistor, and a system including the same.

In an embodiment of the present invention, a semiconductor apparatus may include: a reference voltage generator suitable for generating first and second pull-up reference voltages based on a pull-up control signal, and generating first and second pull-down reference voltages based on a pull-down control signal; and a calibrator suitable for generating a pull-up resistor code corresponding to an external reference resistor based on the first and second pull-up reference voltages, and generating a pull-down resistor code corresponding to the external reference resistor based on the first and second pull-down reference voltages and the pull-up resistor code.

In an embodiment of the present invention, a system may include: a master device; and a slave device communicating with the master device through a signal bus. The slave device includes a calibration circuit for setting the resistor of an input/output terminal coupled to the signal bus to a value corresponding to an external reference resistor. The calibration circuit may include: a reference voltage generator suitable for generating first and second pull-up reference voltages based on a pull-up control signal, and generating first and second pull-down reference voltages based on a pull-down control signal; and a calibrator suitable for generating a pull-up resistor code corresponding to the external reference resistor based on the first and second pull-up reference voltages, and generating a pull-down resistor code corresponding to the external reference resistor based on the first and second pull-up reference voltages and the pull-up resistor code.

BRIEF DESCRIPTION OF THE DRAWINGS

Features, aspects, and embodiments are described it conjunction with the attached drawings, in which.

DETAILED DESCRIPTION

Figure 1:
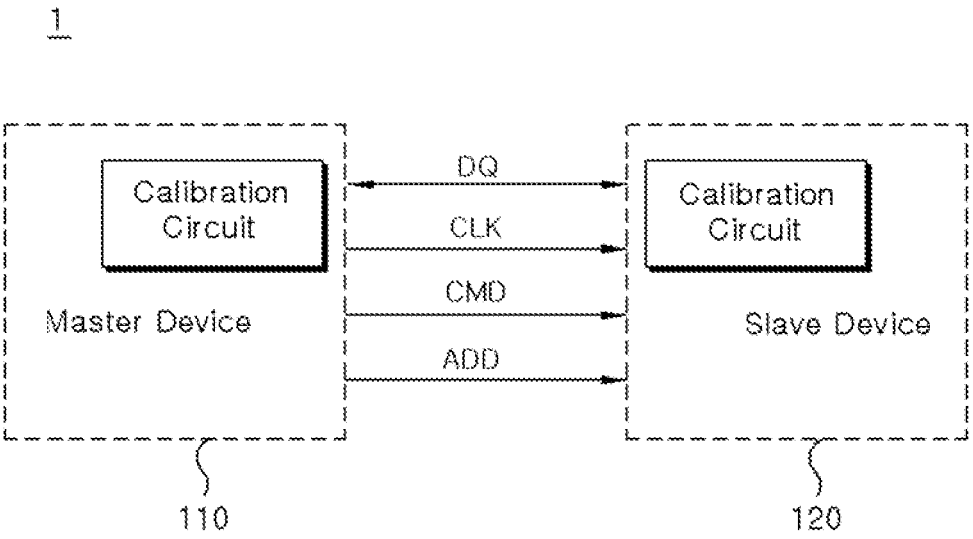
FIG. 1 is a diagram illustrating a system according to an embodiment of the present invention.

A calibration circuit of a semiconductor apparatus and a system including the same according to the present invention will be described below with reference to the accompanying drawings through exemplary embodiments.

The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, reference numerals correspond directly to the like parts in the various figures and embodiments of the present invention.

The drawings are not necessarily to scale and, in some instances, proportions may have been exaggerated in order to clearly illustrate features of the embodiments. In this specification, specific terms have been used. The terms are used to describe the present invention, and are not used to qualify the sense or limit the scope of the present invention.

It is also noted that in this specification, 'and/or' represents that one or more of components arranged before and after 'and/or' is included. Furthermore, "connected/coupled" refers to one component not only directly coupling another component but also indirectly coupling another component through an intermediate component. In addition, a singular form may include a plural form as long as it is not specifically mentioned in a sentence. Furthermore, 'include/comprise' or 'including/comprising' used in the specification represents that one or more components, steps, operations, and elements exist or are added.

FIG. 1 is a diagram illustrating a system 1 according to an embodiment of the present invention. Referring to FIG. 1, the system 1 may include a master device 110 and a slave device 120. The master device 110 may control the slave device 120, and the slave device 120 may perform predetermined operations according to control of the master device 110. The master device 110 and the slave device 120 may be coupled through a plurality of signal buses, and communicate with each other by transmitting and receiving signals through the plurality of signal buses. The system 1 may include a memory system, and the master device 110 may include a host device. The master device 110 may include a memory controller or host processor coupled to the slave device 120. The master device 110 may include a central processing unit (CPU), a graphics processing unit (GPU), a digital signal processor (DSP), one or more processor cores, a single core processor, a dual core processor, a multiple core processor, a microprocessor, a host processor, a controller, a plurality of processors or controllers, a chip, a micro-chip, a logic circuit, and an integrated circuit (IC). The slave device 120 may include a memory device. The slave device 120 may include a volatile memory device such as a dynamic random access memory (DRAM) and a nonvolatile memory device such as a flash memory, a phase-change random access memory (PCRAM), a resistive random access memory (ReRAM), a ferroelectric random access memory (FeRAM), a magnetic random access memory (MRAM), or a spin-transfer torque random access memory (STT-RAM). Furthermore, the slave device 120 may be implemented with a combination of a volatile memory device and a nonvolatile memory device. Each of the master device 110 and the slave device 120 forming the system 1 may be implemented as an independent device, or the master device 110 and the slave device 120 may be packaged as a single package and implemented as a system in package, a system on chip, a package on package, or a flip-chip package.

The master device 110 and the slave device 120 may be coupled through a data bus DQ, a clock bus CLK, a command bus CMD, and an address bus ADD. The data bus DQ may transmit data from the master device 110 to the slave device 120 or transmit data from the slave device 120 to the master device 110. The clock bus CLK may transmit a clock signal from the master device 110 to the slave device 120. The command bus CMD and address bus ADD may transmit a command signal and an address signal from the master device 110 to the slave device 120.

An input/output terminal of the master device 110, coupled to a signal bus, may have an impedance value different from an input/output terminal of the slave device 120, coupled to the same signal bus. Specifically, an input/output terminal of the master device 110, coupled to the data bus DQ, may have an impedance value different from an input/output terminal of the slave device 120, coupled to the data bus DQ. When the input/output terminals of the master device 110 and the slave device 120 have different impedance values, a signal transmitted from one device to the other device may not be precisely transmitted. Thus, it may be important to match the impedance values of the input/output terminals of the devices coupled to the bus, to precisely perform communication. Such an operation may be referred to as impedance matching. For impedance matching, the master device 110 and the slave device 120 may perform a termination operation. The termination operation is an operation of setting the impedance value of the input/output terminal of the slave device 120 to have corresponding to the impedance value of the input/output terminal of the master device 110. To precisely perform impedance matching through the termination operation, the resistance value of the input/output terminal of the master device 110 and the resistance value of the input/output terminal of the slave device 120 need to be regulated according to a predetermined reference value. For this operation, each of the master device 110 and the slave device 120 may include a calibration circuit. Each of the master device 110 and the slave device 120 may include an external reference resistor, and set the resistance value of the input/output terminal thereof to a value corresponding to the external reference resistor through the calibration circuit.

Figure 2:
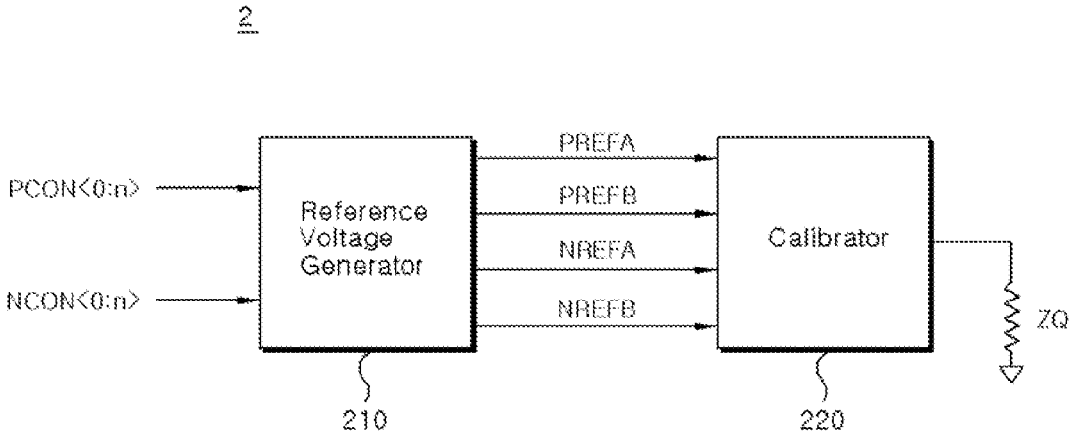
FIG. 2 is a block diagram illustrating a calibration circuit according to an embodiment of the present invention.

FIG. 2 is a block diagram illustrating a calibration circuit 2 according to an embodiment of the present invention shown in FIG. 1. The calibration circuit 2 may include the calibration circuit of the slave device 120 illustrated in FIG. 1. The calibration circuit 2 may include a reference voltage generator 210, a calibrator 220, and an external reference resistor ZQ. The reference voltage generator 210 may receive a pull-up control signal PCON<0:n> and a pull-down control signal NCON<0:n> and generate first and second pull-up reference voltages PREFA and PREFB and first and second pull-down reference voltages NREFA and NREFB. The reference voltage generator 210 may generate the first and second pull-up reference voltages PREFA and PREFB based on the pull-up control signal PCON<0:n>, and generate the first and second pull-down reference voltages NREFA and NREFB based on the pull-down control signal NCON<0:n>. The first and second pull-up reference voltages PREFA and PREFB may be used to set a pull-up resistor value corresponding to the external reference resistor ZQ, and the first and second pull-down reference voltages NREFA and NREFB may be used to set a pull-down resistor value corresponding to the external reference resistor ZQ. The first pull-up reference voltage PREFA may have a voltage (i.e. voltage level) higher than the second pull-up reference voltage PREFB, and the first pull-down reference voltage NREFA may have a voltage higher than the second pull-down reference voltage NREFB. The first pull-up reference voltage PREFA and the first pull-down reference voltage NREFA may have the same voltage, or have different voltages according to the pull-up control signal PCON<0:n> and the pull-down control signal NCON<0:n>. Similarly, the second pull-up reference voltage PREFB and the second pull-down reference voltage NREFB may have the same voltage, or have different voltages according to the pull-up control signal PCON<0:n> and the pull-down control signal NCON<0:n>. The pull-up control signal PCON<0:n> and the pull-down control signal NCON<0:n> may have the same value or different values. Furthermore, the value of the pull-up control signal PCON<0:n> may be differently set regardless of the pull-down control signal NCON<0:n>, and the value of the pull-down control signal NCON<0:n> may also be differently set regardless of the pull-up control signal PCON<0:n>. The pull-up control signal PCON<0:n> and the pull-down control signal NCON<0:n> may be provided from outside the slave device 120, or generated in the slave device 120.

The calibrator 220 may receive the first and second pull-up reference voltages PREF and PREFB and the first and second pull-down, reference voltages NREFA and NREFB, and be coupled to the external reference resistor ZQ. The calibrator 220 may set a pull-up resistor value corresponding to the external reference resistor ZQ based on the first and second pull-up reference voltages PREF and PREFB. The calibrator 220 may generate a pull-up resistor code for setting the pull-up resistor value corresponding to the external reference resistor ZQ. Furthermore, the calibrator 220 may set a pull-down resistor value corresponding to the external reference resistor ZQ based on the first and second pull-down reference voltages NREF and NREFB. The calibrator 220 may generate a pull-down resistor code for setting the pull-down resistor value corresponding to the external reference resistor ZQ.

Figure 3:
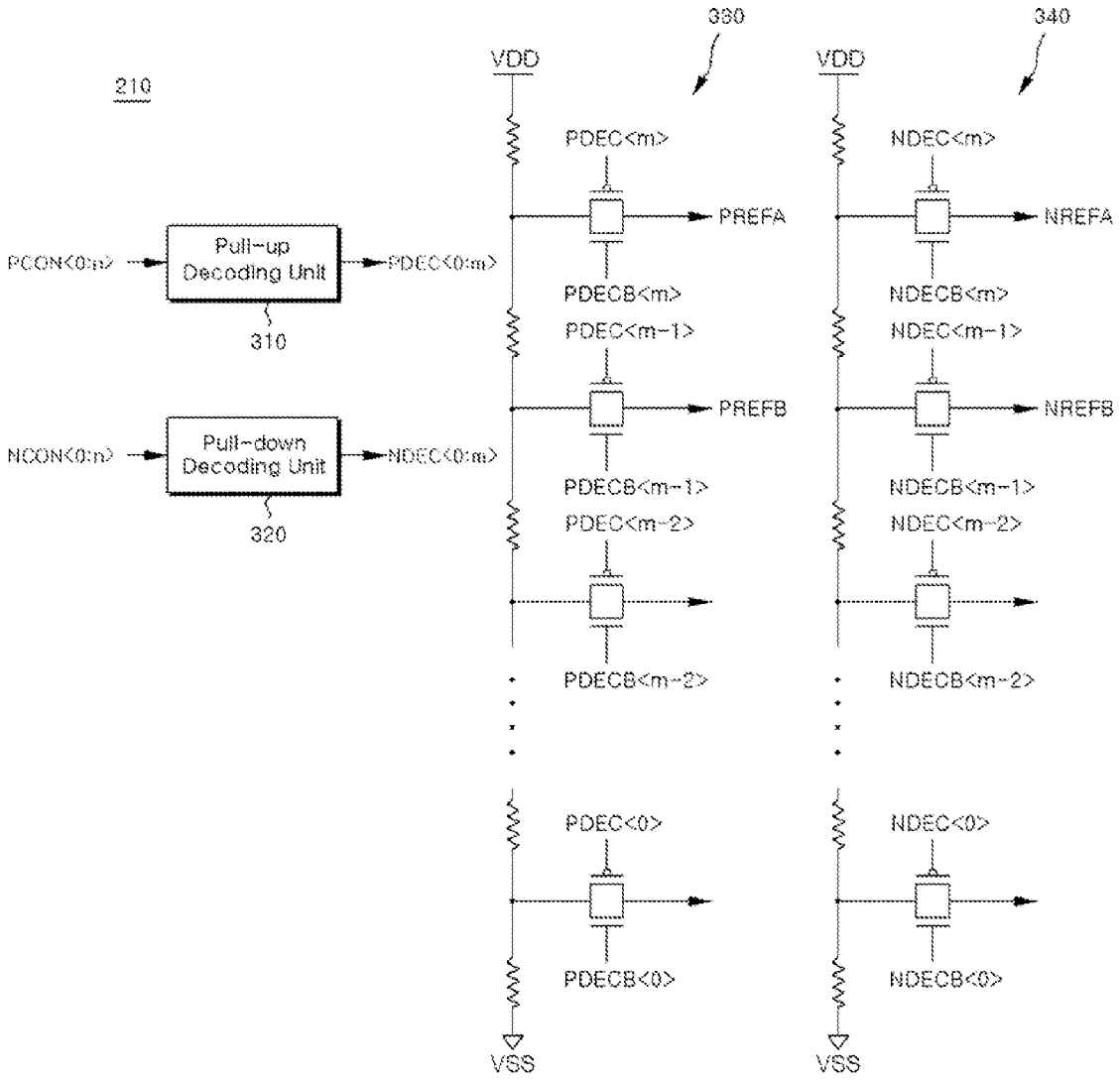
FIG. 3 is a detailed diagram of a reference voltage generator shown in FIG. 2.

FIG. 3 is a detailed diagram of the reference voltage generator 210 shown in FIG. 2. In FIG. 3 the reference voltage generator 210 may include a pull-up decoding unit 310, a pull-up reference voltage trimming unit 330, a pull-down decoding unit 320, and a pull-down reference voltage trimming unit 340. The pull-up decoding unit 310 may decode the pull-up control signal PCON<0:n> and generate a pull-up decoding signal PDEC<0:m>. The pull-up reference voltage trimming unit 330 may output the first and second pull-up reference voltages PREFA and PREFB according to the pull-up decoding signal PDEC<0:m> The pull-up reference voltage trimming unit 330 may include a plurality of resistors coupled in series between a power supply voltage terminal VDD and a ground voltage terminal VSS and a plurality of pass gates configured to output voltages of nodes coupled to the respective resistors in response to the corresponding bits of the pull-up decoding signal PDEC<0:m>. The plurality of pass gates may be turned on in response to the corresponding bits of the pull-up decoding signal PDEC<0:m>, and voltages of specific nodes coupled to the turned-on pass gates may be provided as the first and second pull-up reference voltage PREFA and PREFB. FIG. 3 illustrates that the pull-up reference voltage trimming unit 330 has a simple configuration.

However, the pull-up reference voltage trimming unit 330 may be implemented as various types of circuits having a function of outputting different voltages according to the pull-up decoding signal PDEC<0:m> Furthermore, the voltages generated as the first and second pull-up reference voltages PREA and PREB may be selected in various ways depending on a designer's preferences or the operating environment of a given semiconductor apparatus, in consideration of the most optimal voltage for the calibration operation.

The pull-down decoding unit 320 may decode the pull-down control signal PCON<0:n> and generate a pull-down decoding signal NDEC<0:m>. Like the pull-up reference voltage trimming unit 330, the pull-down reference voltage trimming unit 340 may include a plurality of resistors coupled in series between the power supply voltage terminal VDD and the ground voltage terminal VSS and a plurality of pass gates configured to output voltages of nodes coupled to the respective resistors in response to the corresponding bits of the pull-down decoding signal NDEC<0:m>. The plurality of pass gates may be turned on in response to the corresponding bits of the pull-down decoding signals NDEC<0:m>, and voltages of specific nodes coupled to the turned-on pass gates may be provided as the first and second pull-down reference voltage NREFA and NREFB.

Figure 4:
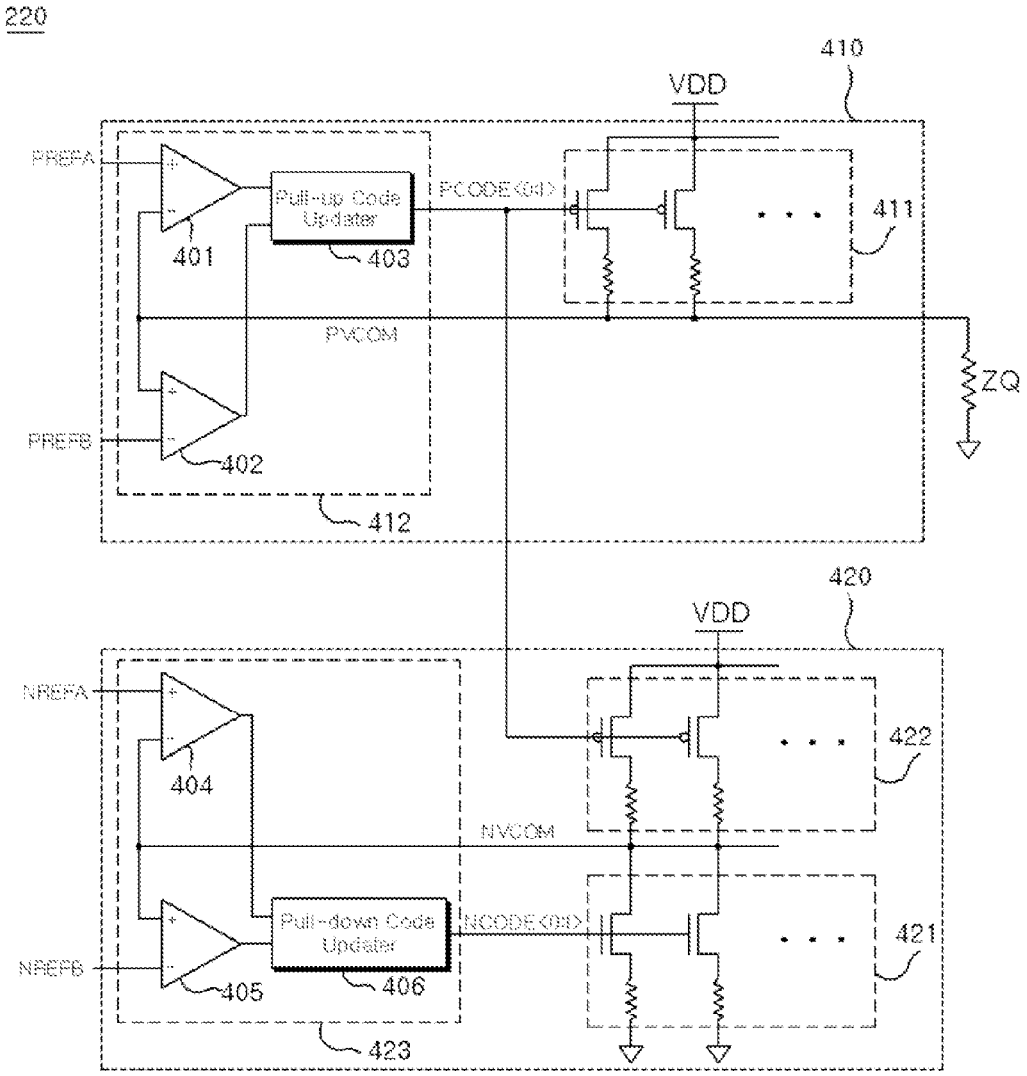
FIG. 4 is a detailed diagram of a calibrator shown in FIG. 2.

FIG. 4 is a detailed diagram of the calibrator 220 shown in FIG. 2. Referring to FIG. 4, the calibrator 220 may include a pull-up resistor setting unit 410 and a pull-down resistor setting unit 420. The pull-up reference setting unit 410 may be coupled to the external reference resistor ZQ, and receive the first and second pull-up reference voltages PREFA and PREFB. The pull-up resistor setting unit 410 may set a pull-up resistor value corresponding to the external reference resistor ZQ based on the first and second pull-up reference voltages PREF and PREFB. The pull-down reference setting unit 420 may be coupled to the pull-up resistor setting unit 410, and receive the first and second pull-down reference voltages NREFA and NREFB. The pull-down reference setting unit 420 may set a pull-down resistor value corresponding to the external reference resistor ZQ based on the first and second pull-down reference voltages NREF and NREFB.

Referring to FIG. 4, the pull-up resistor setting unit 410 may include a pull-up resistor leg section 411 and a pull-up resistor code generator 412. The pull-up resistor leg section 411 may have a resistor value which is varied according to the pull-up resistor code PCODE<0:l>. The pull-up resistor leg section 411 may include a plurality of legs coupled in parallel according to the pull-up resistor code PCODE<0:l>. Each of the legs has a unit resistor value. For example, as illustrated in FIG. 4, each of the legs included in the pull-up resistor leg section 411 may include a unit resistor and a P-channel MOS transistor having a gate receiving the pull-up resistor code PCODE<0:l>, a source receiving a power supply voltage VDD, and a drain coupled to the unit resistor. The pull-up resistor leg section 411 may set the pull-up resistor value by changing the number of legs enabled according to the pull-up resistor code PCODE<0:l>.

The pull-up resistor code generator 412 may receive the first and second pull-up reference voltages PREFA and PREFB, compare the first and second pull-up reference voltages PREFA and PREFB to a pull-up comparison voltage PVCOM, which is generated according to the ratio of the pull-up resistor to the external reference resistor ZQ, and generate the pull-up resistor code PCODE<0:l>. The pull-up resistor code generator 412 may increase or decrease the pull-up resistor code PCODE<0:l> until the pull-up comparison voltage PVCOM is between the first and second pull-up reference voltages PREFA and PREFB. The pull-up resistor code generator 412 may include a first comparator 401, a second comparator 402, and a pull-up code updater 403. The first comparator 401 may compare the first pull-up reference voltage PREFA and the pull-up comparison voltage PVCOM. The second comparator 402 may compare the second pull-up reference voltage PREFB and the pull-up comparison voltage PVCOM. The pull-up code updater 403 may increase or decrease the value of the pull-up resistor code PCODE<0:l> according to the comparison results of the first and second comparators 401 and 402. For example, the pull-up code updater 403 may decrease the value of the pull-up resistor code PCODE<0:l> in response to the output of the first comparator 401, and increase the value of the pull-up resistor code PCODE<0:l> in response to the output of the second comparator 402. Furthermore, the pull-up code updater 403 may increase or decrease the value of the pull-up resistor code PCODE<0:l> according to the comparison results of the first and second comparators 401 and 402.

Referring to FIG. 4, the pull-down resistor setting unit 420 may include a pull-down resistor leg section 421, a replica pull-up resistor leg section 422, and a pull-down resistor code generator 423. The pull-down resistor leg section 421 may have a resistor value which is varied according to a pull-down resistor code NCODE<0:l>. The pull-down resistor leg section 421 may include a plurality of legs coupled in parallel. Each of the legs has a unit resistor value. For example, each of the legs included in the pull-down resistor leg section 421 may include a unit resistor and an N-channel MOS transistor having a gate receiving the pull-down resistor code NCODE<0:l>, a drain coupled to a node for a pull-down comparison voltage NVCOM, and a source coupled to the unit resistor that is coupled to the ground voltage terminal VSS. The pull-down resistor leg section 421 may set the pull-down resistor by changing the number of legs enabled according to the pull-down resistor code NCODE<0:l>.

The replica pull-up resistor leg section 422 may receive the pull-up resistor code PCODE<0:l> generated from the pull-up resistor code generator 412. The replica pull-up resistor leg section 422 may set a replica pull-up resistor according to the pull-up resistor code PCODE<0:l>. The replica pull-up resistor leg section 422 may include a plurality of legs configured in the same manner as the pull-up resistor leg 411, and a resistor value of the replica pull-up resistor leg section 422 may be set to substantially the same value as that of the pull-up resistor leg 411. Thus, the replica pull-up resistor value set through the replica pull-up resistor leg section 422 may have a value corresponding to the external reference resister ZQ.

The pull-down resistor code generator 423 may receive the first and second pull-down reference voltages NREFA and NREFB, compare the first and second pull-up reference voltages PREFA and PREFB to the pull-down comparison voltage NVCOM which is generated according to the ratio of the replica pull-up resistor to the pull-down resistor, and generate the pull-up resistor code PCODE<0:l>. The pull-down resistor code generator 423 may increase or decrease the pull-down resistor code NCODE<0:l> until the pull-down comparison voltage NVCOM is between the first and second pull-down reference voltages NREFA and NREFB. The pull-down resistor code generator 423 may include a third comparator 404, a fourth comparator 405, and a pull-down code updater 406. The third comparator 404 may compare the first pull-down reference voltage NREFA and the pull-down comparison voltage NVCOM. The fourth comparator 405 may compare the second pull-down reference voltage NREFB and the pull-down comparison voltage NVCOM. The pull-down code updater 406 may increase or decrease the value of the pull-down resistor code NCODE<0:l> according to the comparison results of the third and fourth comparators 404 and 405. For example, the pull-down code updater 406 may decrease the value of the pull-down resistor code NCODE<0:l> in response to the output of the third comparator 404, and increase the value of the pull-down resistor code NCODE<0:l> in response to the output of the fourth comparator 404. Furthermore, the pull-down code updater 406 may increase or decrease the value of the pull-down resistor code NCODE<0:l> according to the comparison results of the third and fourth comparators 404 and 405.

Figure 5:
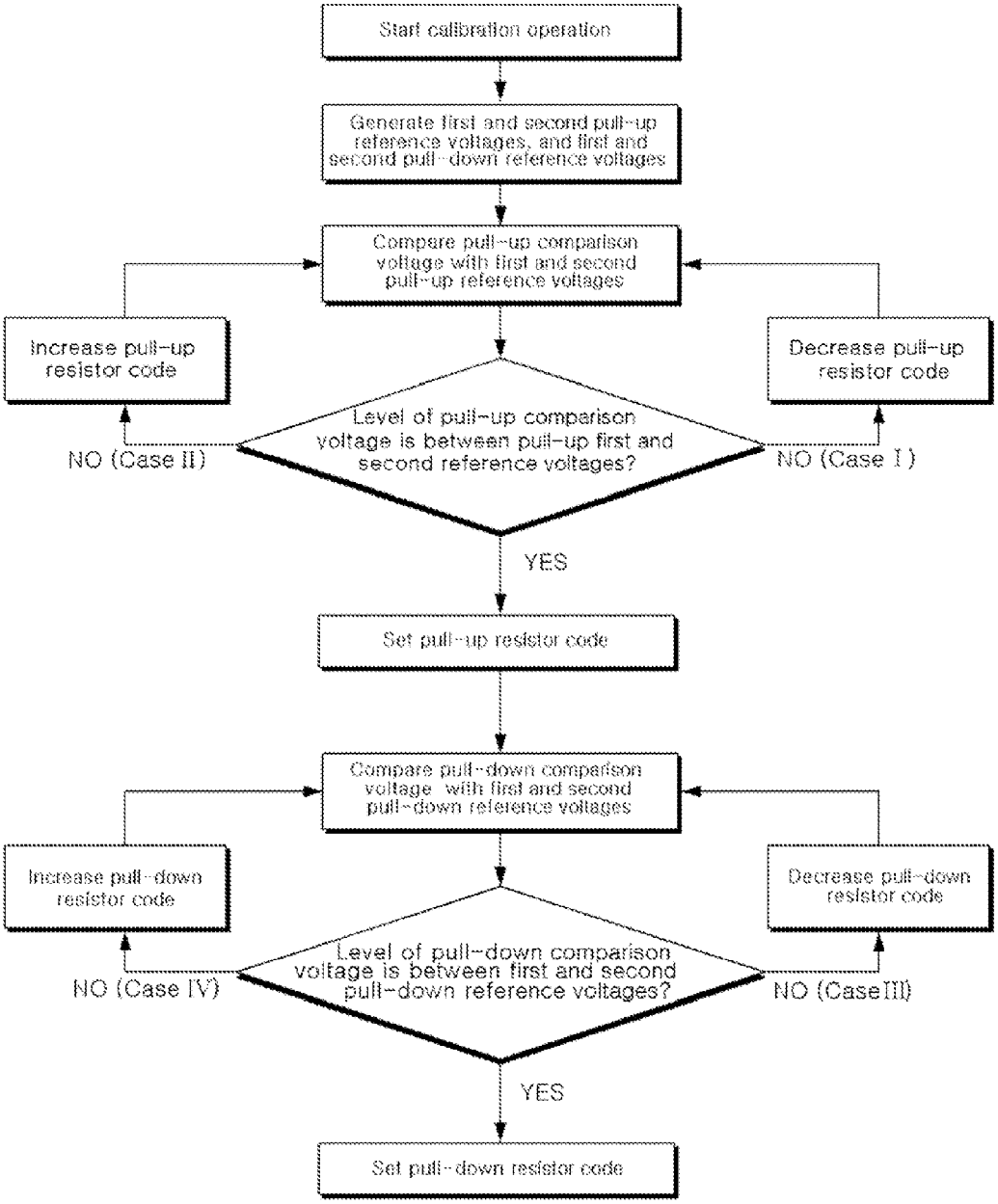
FIG. 5 is a flowchart for describing an operation of a calibration circuit according to an embodiment of the present invention.

FIG. 5 is a flowchart for describing an operation of the calibration circuit according to the embodiment of the present invention. Referring to FIGS. 2 to 5, an operation of the calibration circuit 2 of the semiconductor apparatus will be described as follows. When a calibration operation is started, the reference voltage generator 210 may generate the first and second pull-up reference voltages PREFA and PREFB according to the pull-up control signal PCON<0:n>, and generate the first and second pull-down reference voltages NREFA and NREFB according to the pull-down control signal NCON<0:n>.

The pull-up resistor setting unit 410 may receive the first and second pull-up reference voltages PREFA and PREFB, and compare the first and second pull-up reference voltages PREFA and PREFB to the pull-up comparison voltage PVCOM, which is generated according to the ratio of the pull-up resistor to the external reference resistor ZQ. At this time, when the pull-up comparison voltage PVCOM is higher than the first pull-up reference voltage PREFA, the pull-up code updater 403 may decrease the value of the pull-up resistor code PCODE<0:l> according to the comparison result of the first comparator 401(CASE I). Meanwhile, when the pull-up comparison voltage PVCOM is lower than the second pull-up reference voltage PREFB, the pull-up code updater 403 may increase the value of the pull-up resistor code PCODE<0:l> according to the comparison result of the second comparator 402 (CASE II). The step of comparing the pull-up comparison voltage PVCOM to the first and second pull-up reference voltages PREFA and PREFB and the step of increasing or decreasing the value of the pull-up resistor code PCODE<0:l> may be repeated until the pull-up comparison voltage PVCOM is between the first and second pull-up reference voltages PREFA and PREFB. When pull-up comparison voltage PVCOM is between the first and second pull-up reference voltages PREFA and PREFB, the calibration operation for setting the pull-up resistor may be ended.

The pull-down resistor setting unit 420 may receive the pull-up resistor code PCODE<0:l> to set a replica pull-up resistor, and compare the first and second pull-down reference voltages NREFA and NREFB to the pull-down comparison voltage NVCOM which is generated according to the ratio of the replica pull-up resistor and the pull-down resistor. Like the pull-up resistor setting unit 410, the pull-down resistor setting unit 420 may adjust the value of the pull-down resistor code NCODE<0:l> (CASE III, CASE IV) until the pull-down comparison voltage NVCOM is between the first and second pull-down reference voltages NREFA and NREFB.

After the calibration operation is completed by the calibration circuit 2, the values of the pull-up resistor and the pull-down resistor may not correspond to the external reference resistor ZQ due to process, voltage and temperature (PVT) variation or possible changes in the operating environment of the semiconductor apparatus. At this time, the values of the pull-up control signal PCON<0:n> and the pull-down control signal NCON<0:n> are varied to change the pull-up reference voltages PREFA and PREFB and the pull-down reference voltages NREFA and NREFB, thereby resetting the pull-up resistor and the pull-down resistor. In particular, when one of the pull-up resistor and the pull-down resistor becomes larger than the value of the external reference resistor ZQ and the other becomes smaller than the value of the external reference resistor ZQ, due to the characteristics of the resistors, the values of the pull-up resistor and the pull-down resistor may not be easily reset. Even in this case, the calibration circuit 2 may separately adjust the values of the pull-up control signal PCON<0:n> and the pull-down control signal NCON<0:n>, and separately set the pull-up resistor and the pull-down resistor to correspond to the external reference resistor ZQ.

According to the embodiments of the present invention, the pull-up resistor and the pull-down resistor may be set on the basis of different reference voltages, which makes it possible to increase the degree of freedom for resistor calibration. Furthermore, the resistor calibration may be precisely performed to improve the performance of the semiconductor apparatus and the system.

While certain embodiments have been described above, will be understood to those skilled in the art that the embodiments described are for example only. Accordingly, the inventive concept described herein should not be limited based on the described embodiments. Rather, the inventive concept should only be limited in light of the claims that follow when taken in conjunction with the above description and accompanying drawings.

What is claimed is:

1. A semiconductor apparatus, comprising:

a reference voltage generator suitable for generating first and second pull-up reference voltages based on a pull-up control signal, and generating first and second pull-down reference voltages based on a pull-down control signal; and a calibrator suitable for generating a pull-up resistor code corresponding to an external reference resistor based on the first and second pull-up reference voltages, and generating a pull-down resistor code corresponding to the external reference resistor based on the first and second pull-down reference voltages and the pull-up resistor code.

2. The semiconductor apparatus according to claim 1, wherein the reference voltage generator comprises:

a pull-up decoding unit suitable for decoding the pull-up control signal to generate a pull-up decoding signal;

a pull-up reference voltage trimming unit suitable for outputting the first and second pull-up reference voltages based on the pull-up decoding signal;

a pull-down decoding unit suitable for decoding the pull-down control signal to generate a pull-down decoding signal; and a pull-down reference voltage trimming unit suitable for outputting the first and second pull-down reference voltages based on the pull-down decoding signal.

3. The semiconductor apparatus according to claim 1, wherein the pull-down control signal has a different value from the pull-up control signal.

4. The semiconductor apparatus according to claim 1, wherein the calibrator comprises:

a pull-up resistor setting unit suitable for setting a pull-up resistor value corresponding to the external reference resistor; and a pull-down resistor setting unit suitable for setting a pull-down resistor value corresponding to the external reference resistor.

5. The semiconductor apparatus according to claim 4, wherein the pull-up resistor setting unit comprises:

a pull-up resistor leg section suitable for setting the pull-up resistor according to the pull-up resistor code; and a pull-up resistor code generator suitable for comparing the first and second pull-up resistor voltages to a pull-up comparison voltage, which is generated according to a ratio of the pull-up resistor value and a value of the external reference resistor, to selectively change the pull-up resistor code.

6. The semiconductor apparatus according to claim 5, wherein the pull-up resistor code generator does not change a value of the pull-up resistor code when the pull-up comparison voltage is between the first and second pull-up reference voltages.

7. The semiconductor apparatus according to claim 5, wherein the pull-up resistor code generator changes a value of the pull-up resistor code, when the pull-up comparison voltage is higher than the first pull-up reference voltage or lower than the second pull-up reference voltage, which is lower than the second pull-up reference voltage.

8. The semiconductor apparatus according to claim 5, wherein the pull-up resistor setting unit comprises:

a pull-down resistor leg section suitable for setting the pull-down resistor value according to the pull-down resistor code;

a replica pull-up resistor leg suitable for setting a replica pull-up resistor value having substantially the same resistor value as the pull-up resistor value according to the pull-up resistor code; and a pull-down resistor code generator suitable for comparing the first and second pull-down reference voltages to a pull-down comparison voltage, which is generated according to a ratio of the pull-down resistor value and the replica pull-up resistor value, to selectively change the pull-down resistor code.

9. The semiconductor apparatus according to claim 8, wherein the pull-down resistor code generator does not change a value of the pull-down resistor code when the pull-down comparison voltage is between the first and second pull-down reference voltages.

10. The semiconductor apparatus according to claim 8, wherein the pull-down resistor code generator changes the value of the pull-down resistor code when the pull-down comparison voltage is higher than the first pull-down reference voltage or lower than the second pull-down reference voltage, which is lower than the second pull-down reference voltage.

11. The semiconductor apparatus according to claim 1, wherein when the pull-up resistor value and the pull-down resistor value are set to be different from each other, the pull-up control signal and the pull-down control signal can be separately adjusted.

12. A system comprising:

a master device; and a slave device suitable for communicating with the master device through a signal bus, wherein the slave device comprises a calibration circuit for setting a resistor value corresponding to an external reference resistor, and the calibration circuit comprises:

a reference voltage generator suitable for generating first and second pull-up reference voltages based on a pull-up control signal, and generating first and second pull-down reference voltages based on a pull-down control signal; and a calibrator suitable for generating a pull-up resistor code corresponding to the external reference resistor based on the first and second pull-up reference voltages, and generating a pull-down resistor code corresponding to the external reference resistor based on the first and second pull-up reference voltages and the pull-up resistor code.

13. The system according to claim 12, wherein the reference voltage generator comprises:

a pull-up decoding unit suitable for decoding the pull-up control signal to generate a pull-up decoding signal;

a pull-up reference voltage trimming unit suitable for outputting the first and second pull-up reference voltages based on the pull-up decoding signal;

a pull-down decoding unit suitable for decoding the pull-down control signal to generate a pull-down decoding signal; and a pull-down reference voltage trimming unit suitable for outputting the first and second pull-down reference voltages based on the pull-down decoding signal.

14. The system according to claim 12, wherein the pull-down control signal has a different value from the pull-up control signal.

15. The system according to claim 12, wherein when a pull-up resistor value set according to the pull-up resistor code has a different value from a pull-down resistor value set according to the pull-down resistor code, the pull-up control signal and the pull-down control signal can be separately adjusted.

16. The system according to claim 12, wherein the calibrator comprises:

a pull-up resistor setting unit suitable for setting a pull-up resistor value corresponding to the external reference resistor; and a pull-down resistor setting unit suitable for setting a pull-down resistor value corresponding to the external reference resistor.

17. The system according to claim 16, wherein the pull-up resistor setting unit comprises:

a pull-up resistor leg section suitable for setting the pull-up resistor according to the pull-up resistor code; and a pull-up resistor code generator suitable for comparing the first and second pull-up resistor voltages to a pull-up comparison voltage, which is generated according to a ratio of the pull-up resistor value and a value of the external reference resistor, to selectively change the pull-up resistor code.

18. The system according to claim 17, wherein the pull-up resistor code generator does not change a value of the pull-up resistor code when the pull-up comparison voltage is between the first and second pull-up reference voltages.

19. The system according to claim 16, wherein the pull-down resistor setting unit comprises:

a pull-down resistor leg section suitable for setting the pull-down resistor value according to the pull-down resistor code;

a replica pull-up resistor leg suitable for setting a replica pull-up resistor value having substantially the same resistor value as the pull-up resistor value according to the pull-up resistor code; and a pull-down resistor code generator suitable for comparing the first and second pull-down reference voltages to a pull-down comparison voltage, which is generated according to a ratio of the pull-down resistor value and the replica pull-up resistor value, to selectively change the pull-down resistor code.

* * * * *